US010772373B2

(12) United States Patent
Bancroft

(10) Patent No.: US 10,772,373 B2
(45) Date of Patent: Sep. 15, 2020

(54) HELMET ASSEMBLY AND HELMET FASTENING SYSTEM

(71) Applicant: Allen John Bancroft, Zelienople, PA (US)

(72) Inventor: Allen John Bancroft, Zelienople, PA (US)

( * ) Notice: Subject to any disclaimer, the term of this patent is extended or adjusted under 35 U.S.C. 154(b) by 227 days.

(21) Appl. No.: 15/813,839

(22) Filed: Nov. 15, 2017

(65) Prior Publication Data

US 2018/0084859 A1 Mar. 29, 2018

Related U.S. Application Data

(63) Continuation of application No. 13/679,973, filed on Nov. 16, 2012, now abandoned.

(60) Provisional application No. 61/606,879, filed on Mar. 5, 2012.

(51) Int. Cl.
*A42B 3/08* (2006.01)

(52) U.S. Cl.
CPC ..... *A42B 3/08* (2013.01)

(58) Field of Classification Search
CPC ..... A42B 3/08; A42B 3/085; A42B 3/185; A42B 3/205; A41D 2300/324; A41D 2600/10
USPC ..... 2/421, 422; 24/3.1, 368; 411/520
See application file for complete search history.

(56) References Cited

U.S. PATENT DOCUMENTS 2,825,112 A * 3/1958 Frieder ..... A42B 3/08 24/601.6
3,237,203 A * 3/1966 Nielsen ..... A42B 3/225 2/10
3,283,336 A * 11/1966 Critser ..... A42B 3/20 2/9
3,447,163 A * 6/1969 Tojeiro ..... A42B 3/124 2/412
3,480,966 A * 12/1969 Molitoris ..... A42B 3/08 2/421
4,461,044 A * 7/1984 Reiterman ..... A42B 3/08 2/421
4,692,947 A * 9/1987 Black ..... A42B 3/20 2/421
4,885,807 A * 12/1989 Snow, Jr. ..... A42B 3/20 2/424
4,985,938 A * 1/1991 Snow, Jr. ..... A42B 3/20 2/424
5,675,875 A * 10/1997 Servatius ..... A42B 3/20 2/424
5,722,130 A * 3/1998 Baader ..... A44B 17/00 24/662
6,138,283 A * 10/2000 Kress ..... A42B 3/328 2/411

(Continued)

*Primary Examiner* — Alissa L Hoey
(74) *Attorney, Agent, or Firm* — Patent Law of Virginia, PLLC; Brian J. Teague

(57) ABSTRACT

A helmet assembly and helmet fastening system that uses a spring loaded female fastener attached to the chinstrap and a matching male fastener attached to a helmet that makes it easy to attach the chinstrap to the helmet and difficult to detach the chinstrap from the helmet unless the plunger is intentionally pulled back (i.e., released or disengaged). This positive connection takes a tremendous amount of force to disengage unless the plunger is pulled back, thereby keeping the chinstrap attached to the helmet and the helmet in place.

9 Claims, 17 Drawing Sheets

(56) References Cited

U.S. PATENT DOCUMENTS

| | | | | |
|---|---|---|---|---|
| 6,324,701 | B1 * | 12/2001 | Alexander | A42B 3/08 2/421 |
| 6,389,606 | B1 * | 5/2002 | Galet | A62B 18/084 2/410 |
| 6,481,024 | B1 * | 11/2002 | Grant | A42B 3/08 2/421 |
| 6,934,971 | B2 * | 8/2005 | Ide | A42B 3/08 2/425 |
| 7,181,776 | B2 * | 2/2007 | Necci | A42B 3/288 128/201.23 |
| 7,246,384 | B2 * | 7/2007 | Bentz | A42B 3/08 2/421 |
| 8,453,269 | B2 * | 6/2013 | Hampton, II | A42B 3/08 2/421 |
| 9,439,471 | B2 * | 9/2016 | Wehtje | A42B 3/32 |
| 2007/0089219 | A1 * | 4/2007 | Trainor | A42B 3/08 2/421 |
| 2011/0094018 | A1 * | 4/2011 | Rogers | A42B 3/08 2/421 |
| 2011/0289660 | A1 * | 12/2011 | Gowen | A42B 3/08 2/421 |
| 2012/0278976 | A1 * | 11/2012 | Benton | A42B 3/08 2/421 |
| 2013/0227767 | A1 * | 9/2013 | Bancroft | A42B 3/08 2/421 |
| 2014/0068843 | A1 * | 3/2014 | Wegener | A42B 3/08 2/421 |
| 2018/0049507 | A1 * | 2/2018 | McCashin | A42B 3/003 |

* cited by examiner 28
22
32
34
50
26
30
36
16
40
42
46
44
18
A
A

FIG 8B
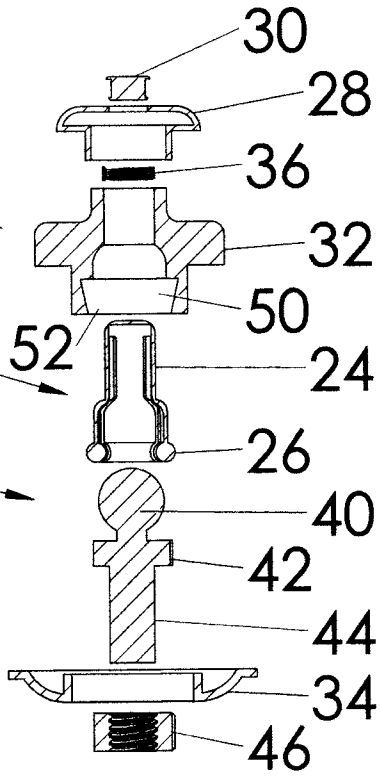
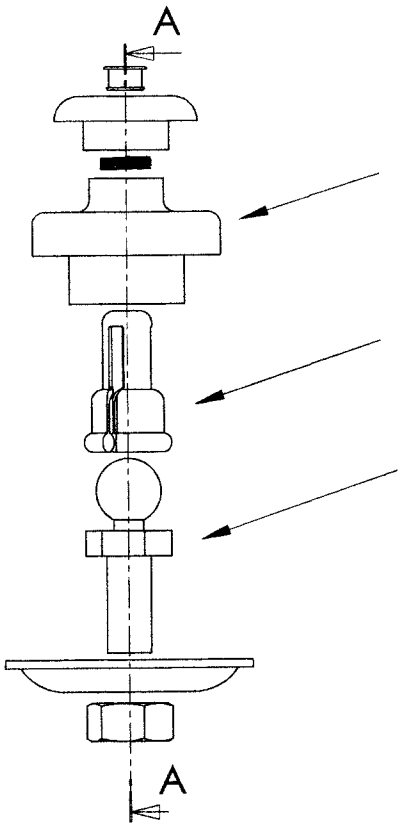
FIG 8A

HELMET ASSEMBLY AND HELMET FASTENING SYSTEM

CROSS-REFERENCE TO RELATED APPLICATIONS

This application is a continuation of and claims priority to U.S. patent application Ser. No. 13/679,973, filed Nov. 16, 2012, which in turn claims priority to U.S. Provisional Application Ser. No. 61/606,879, filed Mar. 5, 2012, the contents of which are incorporated herein by reference in their entirety.

FIELD OF THE INVENTION

The present invention relates to helmets and systems for fastening helmets.

BACKGROUND

Helmets worn by participants in recreational, amateur, and professional sports (e.g., football, baseball, racing (auto, horse, etc.), lacrosse, hockey, etc.) provide important protection against head injuries, but can only provide such protection when the helmet is in place on the participant's head. Such helmets typically use chinstraps to help keep the helmet in place. However, such helmets using chinstraps are coming off participants' heads at an alarming rate, thereby negating any potential protection and exposing the participant to a significantly increased risk of head injury.

In helmets currently in use, the chinstrap is attached to the helmet using two to four standard "snap" type fastener (see, e.g., http://www.schuttsports.com/aspx/Sport/ProductCatalog.aspx?id=523) that each comprises a male piece attached to the helmet and a female piece attached to the chinstrap. The chinstrap is fastened to the helmet by pressing the female piece onto the corresponding male piece such that the pieces snap together. The chinstrap is unfastened by pulling on the chinstrap to disconnect the female piece from the male piece.

Very little force is required to disconnect the female piece from the male piece. As a result of this very small amount of force required, current chinstraps disconnect easily upon impact (such as occurs when two football players collide during play). When this happens the helmet can easily come off exposing the wearer to potential danger and possible head or brain injury, such as concussions which unfortunately occur quite frequently in football.

BRIEF SUMMARY

In one embodiment of the invention, a helmet assembly comprises a helmet and a chinstrap. The helmet comprises an outer shell, a recess defined in the outer shell, and a stud affixed within the recess such that at least a portion of the stud is below a surface of the outer shell. The chinstrap comprises a connector affixed to the chinstrap configured to releasably attach to the stud to retain the chinstrap to the helmet. The recess is sized such that at least a portion of the connector is below the surface of the outer shell when the connector is attached to the stud.

The stud comprises an enlarged head. The connector comprises a housing and an actuator. The housing comprises a recess and an underside with an opening into the recess. The actuator is movable within the recess and along a longitudinal axis of the housing between a first position in which the actuator engages the stud to retain the connector to the helmet and a second position in which the actuator disengages the stud to release the connector from the helmet. The actuator comprises (i) an upper grasping portion extending outside of the housing and adapted to enable a user to move the actuator from the first to the second position, (ii) a resilient, radially-expanding enlarged lower portion, and (iii) a middle portion connecting the lower portion to the upper portion. The recess has an upper portion sized to receive at least a top portion of the enlarged head and a lower portion comprising an inverse frusto-conical shape that is wider at a top end and narrower at a bottom end. The enlarged lower portion of the actuator extends at least partly under the enlarged head of the stud when the actuator is in the first position, with the narrower end of the lower portion of the recess restricting outward movement of the enlarged lower portion of the actuator, thereby trapping the enlarged head within the recess and restricting separation of the connector and the stud. When the actuator is in the second position, the wider end of the lower portion of the recess allows outward movement of the enlarged lower portion of the actuator, thereby allowing the enlarged head to exit the recess and allowing separation of the connector and the stud. The connector may further comprise a spring to bias the actuator toward the first position.

The recess may be molded into the outer shell.

The recess may comprise a wall portion and a floor portion. One end of the wall portion abuts the outer shell. The floor portion abuts and closes off an opposite end of the wall portion. The stud is affixed to the floor portion.

In another embodiment of the invention, a helmet assembly comprises a helmet and a chinstrap. The helmet comprises an outer shell, a hole defined in the outer shell, a recess assembly mounted in or adjacent the hole defined in the outer shell, and a stud affixed within the recess assembly such that at least a portion of the stud is below a surface of the outer shell. The chinstrap comprises a connector affixed to the chinstrap configured to releasably attach to the stud to retain the chinstrap to the helmet. The recess assembly is sized such that at least a portion of the connector is below the surface of the outer shell when the connector is attached to the stud.

The recess assembly may comprise a wall portion, a floor portion affixed to and closing off one end of the wall portion, and a flange affixed to an opposite end of the wall portion and extending outward from the wall portion. The stud is affixed to the floor portion. The recess assembly is mounted in the hole such that the flange is flush with an outer surface of the outer shell.

The recess assembly may comprise a wall portion, a floor portion affixed to and closing off one end of the wall portion, and a flange affixed to an opposite end of the wall portion and extending outward from the wall portion. The stud is affixed to the floor portion. The recess assembly is mounted adjacent the hole such that the flange is flush with an inner surface of the outer shell.

The recess assembly may comprise a wall portion, a floor portion affixed to and closing off one end of the wall portion, and a flange affixed to the wall portion and extending outward from the wall portion. The stud is affixed to the floor portion. The flange is affixed to the wall portion at a distance from an end of the wall portion opposite the floor portion, the distance corresponding to a thickness of the outer shell. The recess assembly is mounted in the hole such that the flange is flush with an inner surface of the outer shell and the end of the wall portion opposite the floor portion is flush with an outer surface of the outer shell.

In another embodiment of the invention, a helmet fastening system comprises a recess assembly adapted to be mounted in or adjacent a hole defined in an outer shell of a helmet, a stud affixed to the floor portion of the recess assembly such that at least a portion of the stud is below a surface of the outer shell when the recess assembly is mounted in or adjacent the hole, and a chinstrap comprising a connector affixed to the chinstrap configured to releasably attach to the stud to retain the chinstrap to the helmet when the recess assembly is mounted in or adjacent the hole. The recess assembly is sized such that at least a portion of the connector is below the surface of the outer shell when the recess assembly is mounted in or adjacent the hole and when the connector is attached to the stud.

The recess assembly may comprise a wall portion, a floor portion affixed to and closing off one end of the wall portion, and a flange affixed to an opposite end of the wall portion and extending outward from the wall portion. The stud is affixed to the floor portion. The recess assembly is adapted to be mounted in the hole such that the flange is flush with an outer surface of the outer shell.

The recess assembly may comprise a wall portion, a floor portion affixed to and closing off one end of the wall portion, and a flange affixed to an opposite end of the wall portion and extending outward from the wall portion. The stud is affixed to the floor portion. The recess assembly is adapted to be mounted adjacent the hole such that the flange is flush with an inner surface of the outer shell.

The recess assembly may comprise a wall portion, a floor portion affixed to and closing off one end of the wall portion, and a flange affixed to the wall portion and extending outward from the wall portion. The stud is affixed to the floor portion. The flange is affixed to the wall portion at a distance from an end of the wall portion opposite the floor portion, the distance corresponding to a thickness of the outer shell. The recess assembly is adapted to be mounted in the hole such that the flange is flush with an inner surface of the outer shell and the end of the wall portion opposite the floor portion is flush with an outer surface of the outer shell.

In addition to the helmet assemblies and helmet fastening system, as described above, other embodiments of the invention are directed to corresponding methods for fastening helmets.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 8A is a front exploded view of the connector and stud of FIG. 3, showing cross-sectional line A-A.

FIG. 8B is a front exploded sectional view of the connector and stud of FIG. 8A, along line A-A.

DETAILED DESCRIPTION

Embodiments of the invention provide the ability to securely fasten a chinstrap to a helmet, thereby reducing the likelihood that the helmet will unintentionally come off a wearer's head during an impact. The term "helmet" as used herein is intended to be generic, and is intended to encompass any suitable wearable head protection device that is desired to be securely maintained on a wearer's head by way of a securing strap, including but not limited to football helmets, baseball helmets, racing helmets, lacrosse helmets, hockey helmets, or other type of helmets.

Embodiments of the invention use a spring loaded female fastener attached to the chinstrap (which may have a fixed length or may be adjustable) and a matching male fastener attached to the helmet that makes it easy to attach the chinstrap to the helmet and difficult to detach the chinstrap from the helmet unless the plunger is intentionally pulled back (i.e., released or disengaged). This positive connection takes a tremendous amount of force to disengage unless the plunger is pulled back. Embodiments of the invention will keep the chinstrap attached to the helmet and the helmet in place in many situations in which current chinstraps become detached allowing the helmet to come off.

Figure 1:
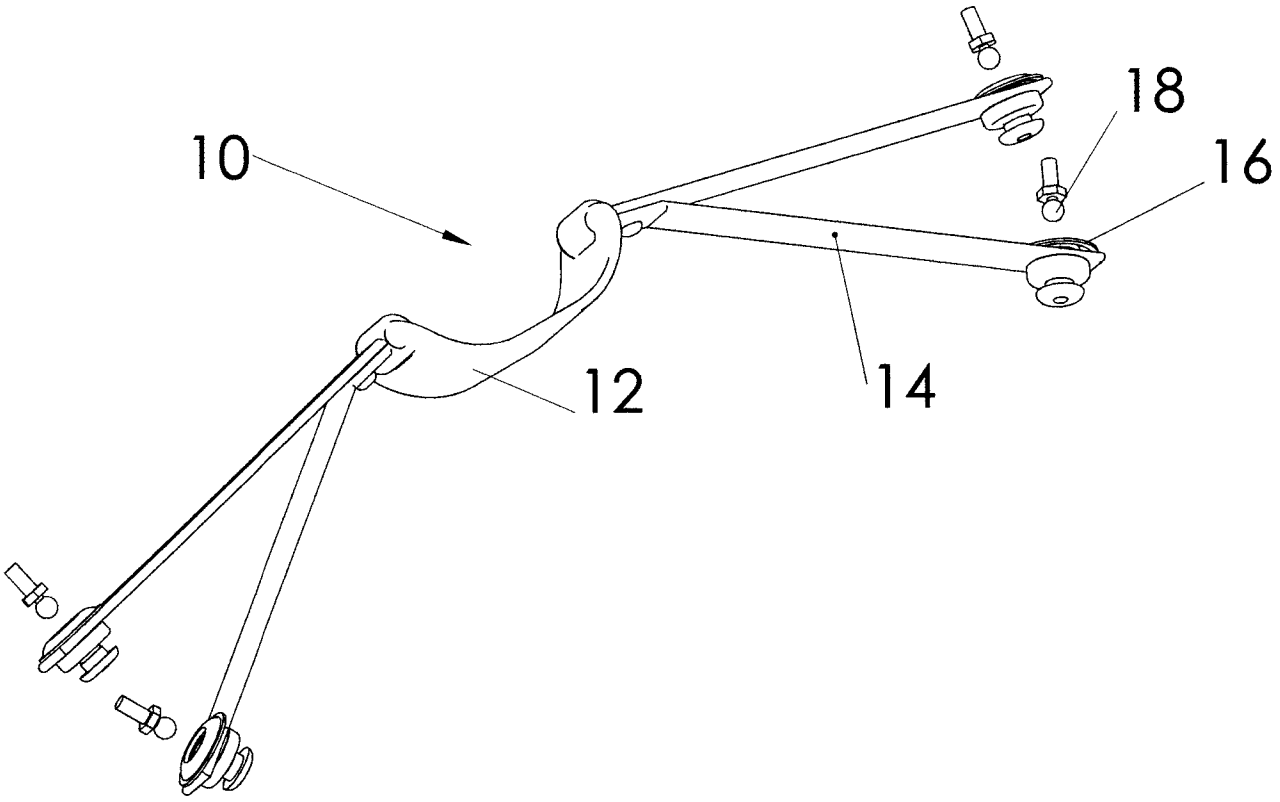
FIG. 1 is an isometric view of a helmet fastening system, in accordance with an embodiment of the present invention.

Referring now to FIG. 1, an isometric view of a helmet fastening system is illustrated in accordance with an embodiment of the present invention. The helmet fastening system 10 comprises a chinstrap 12 having at least one strap 14 (four straps, as is typically used for football helmet chinstraps, are illustrated in FIG. 1) and a female connector 16 affixed at or near an end of at least one strap. While the chinstrap in FIG. 1 has a connector affixed to each strap, embodiments of the invention may comprise a chinstrap having a connector affixed to fewer than all straps. For example, the chinstrap may have a connector affixed to one or more straps on one side of the chinstrap (therefore being removably affixable to the helmet), while the one or more straps on the opposing side are permanently affixed to the helmet. The helmet fastening system 10 also comprises one or more male studs or posts 18 (one for each connector 16) that are securely affixed to the helmet and to which the connectors may be removably affixed.

Figure 2:
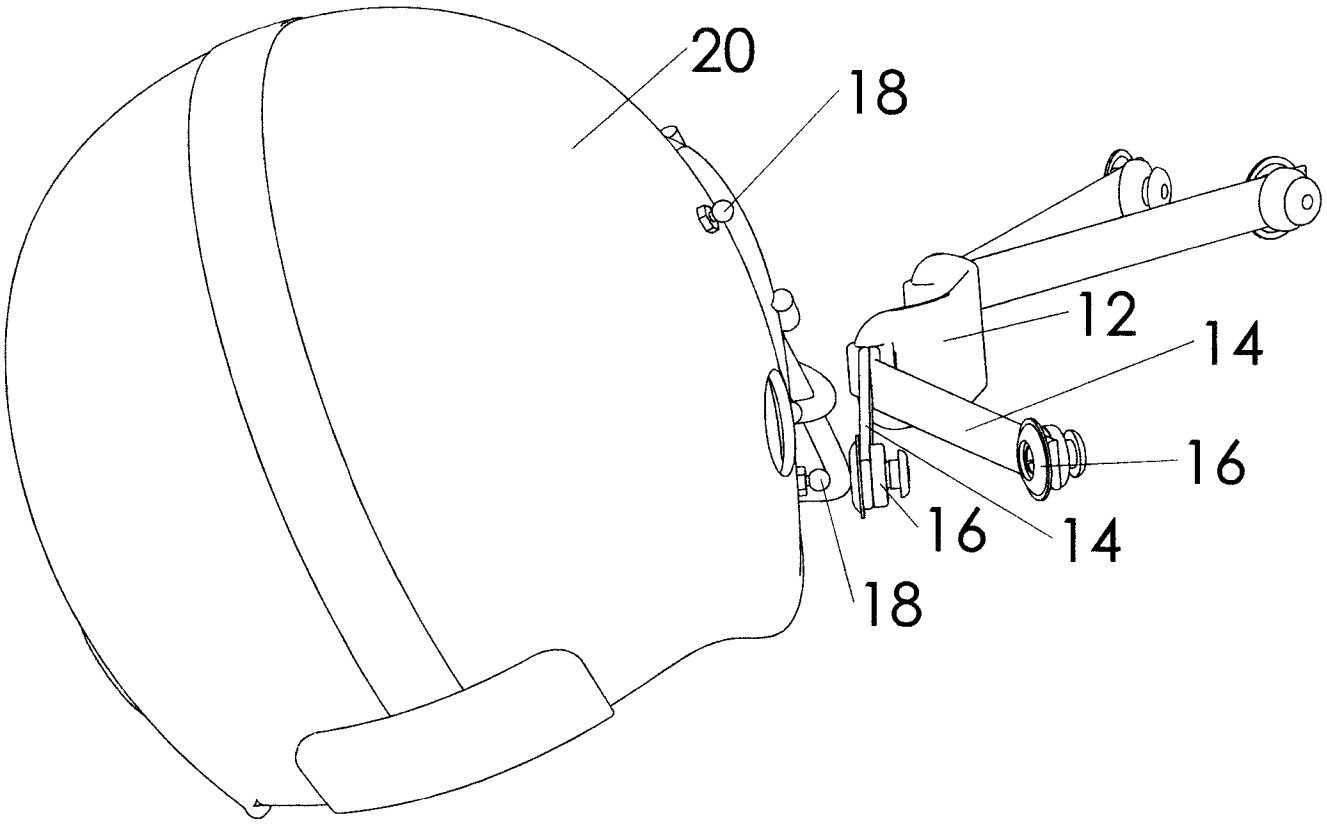
FIG. 2 is a partial isometric view of the helmet fastening system of FIG. 1 partially affixed to a helmet.

FIG. 2 is a partial isometric view of the helmet fastening system of FIG. 1 partially affixed to a helmet. FIG. 2 illustrates two studs 18 affixed to the helmet. FIG. 2 illustrates only one side of the helmet 20, however, in a commercial embodiment of the invention as used in conjunction with a football helmet, it is likely (although not necessary) that two studs 18 will be mounted on each side of helmet 20. Correspondingly, FIG. 2 illustrates chinstrap 12 having four straps 14, each with a connector 16.

FIGS. 3-8 illustrate connector 16 and stud 18 in detail. It should be appreciated that connector 16 and stud 18 together form a known fastening mechanism, such as the "Pull-It-Up Fastener" offered by Sailrite (which individual components can be seen at http://www.sailrite.com/Pull-It-Up-Fastener-Button-Key-LL and http://www.sailrite.com/Pull-It-Up-Fastener-7-16-Machine-Screw-1-4-Short-Key-RR respectively). The connector and stud are illustrated by themselves in FIGS. 3-8, i.e., not affixed to a chinstrap or helmet, respectively, for clarity.

Figure 3:
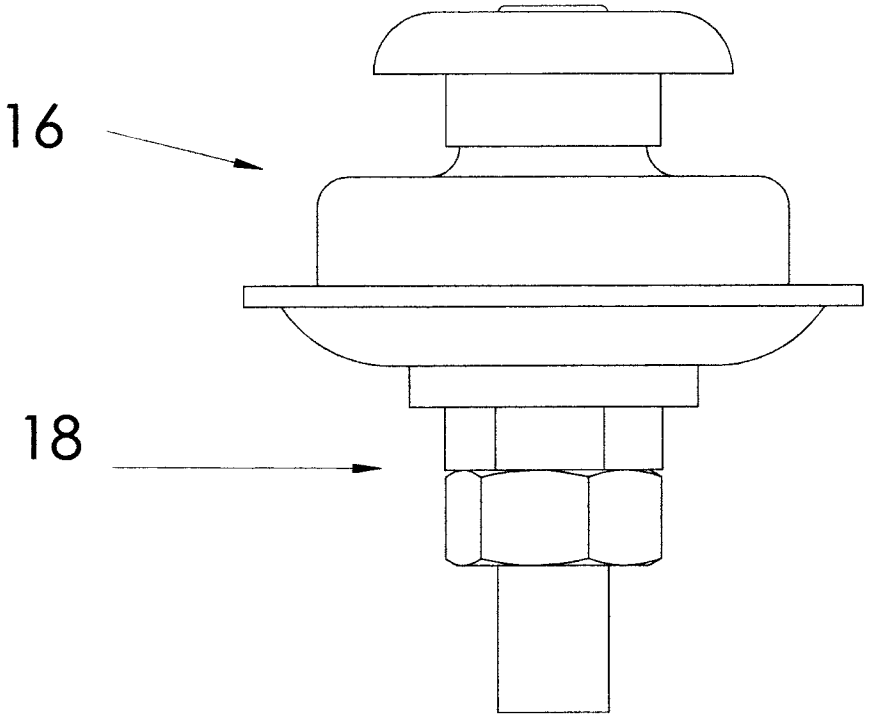
FIG. 3 is a front view of a connector and stud of the helmet fastening system of FIG. 1, in an engaged or fastened position.
Figures 4A, 4B:
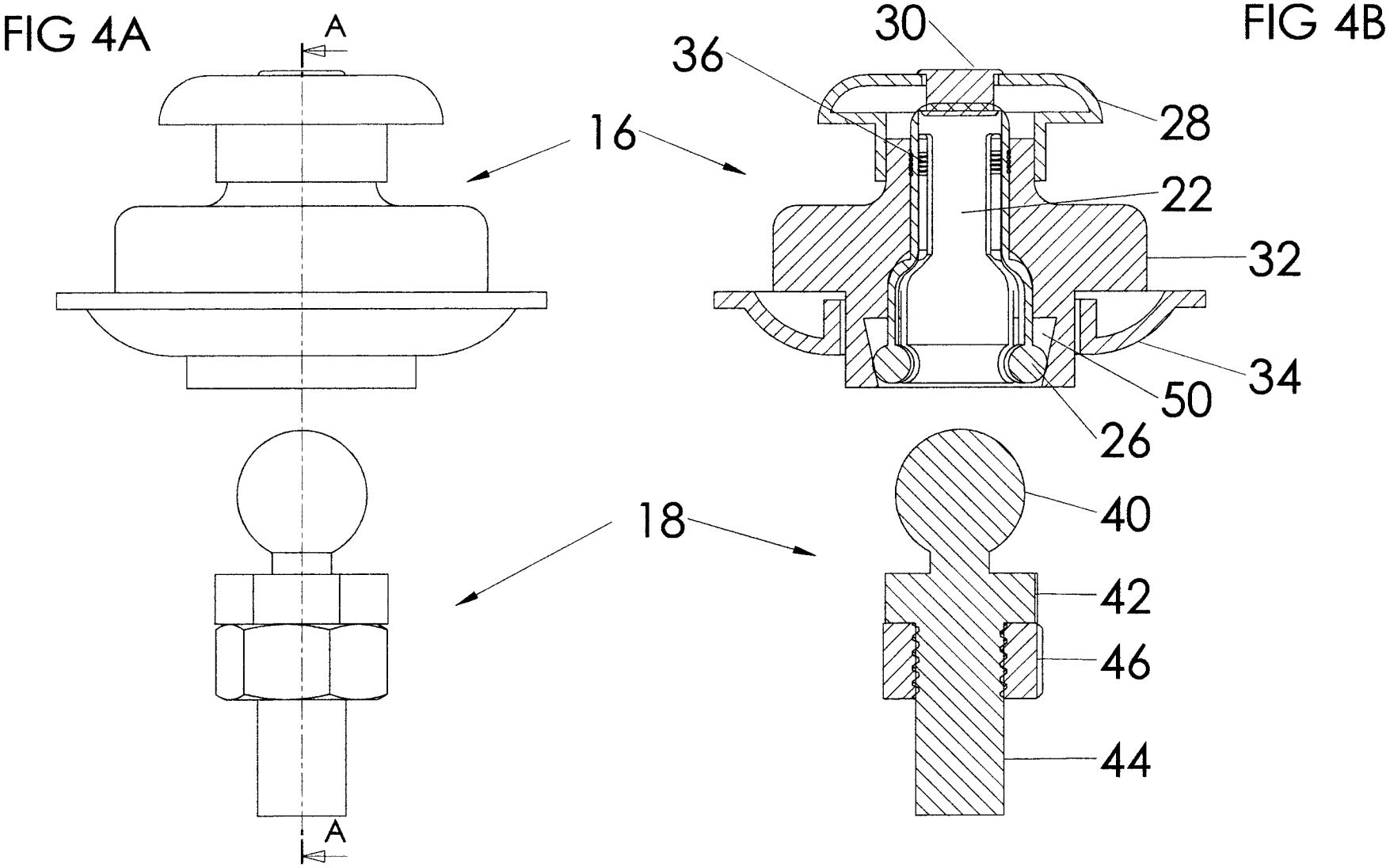
FIG. 4A is a front view of the connector and stud of FIG. 3, in a disengaged or unfastened position, and showing cross-sectional line A-A.
FIG. 4B is a front sectional view of the connector and stud of FIG. 4, along line A-A.
Figure 5B:
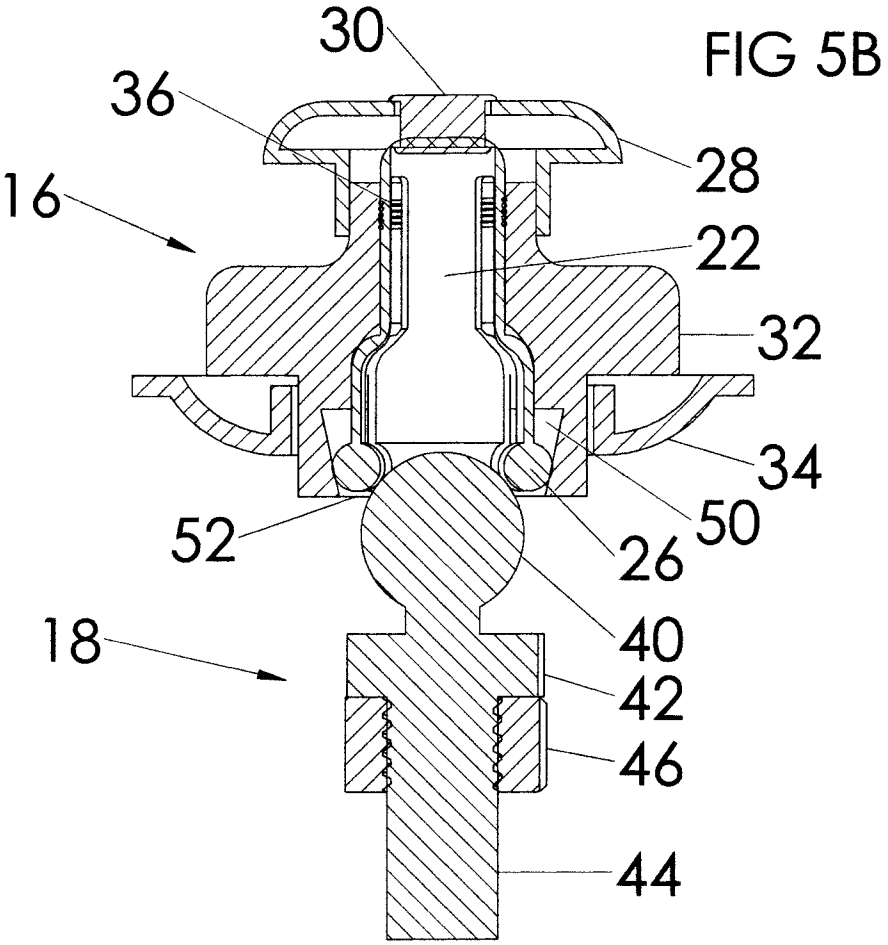
FIG. 5B is a front sectional view of the connector and stud of FIG. 5, along line A-A A.
Figure 5A:
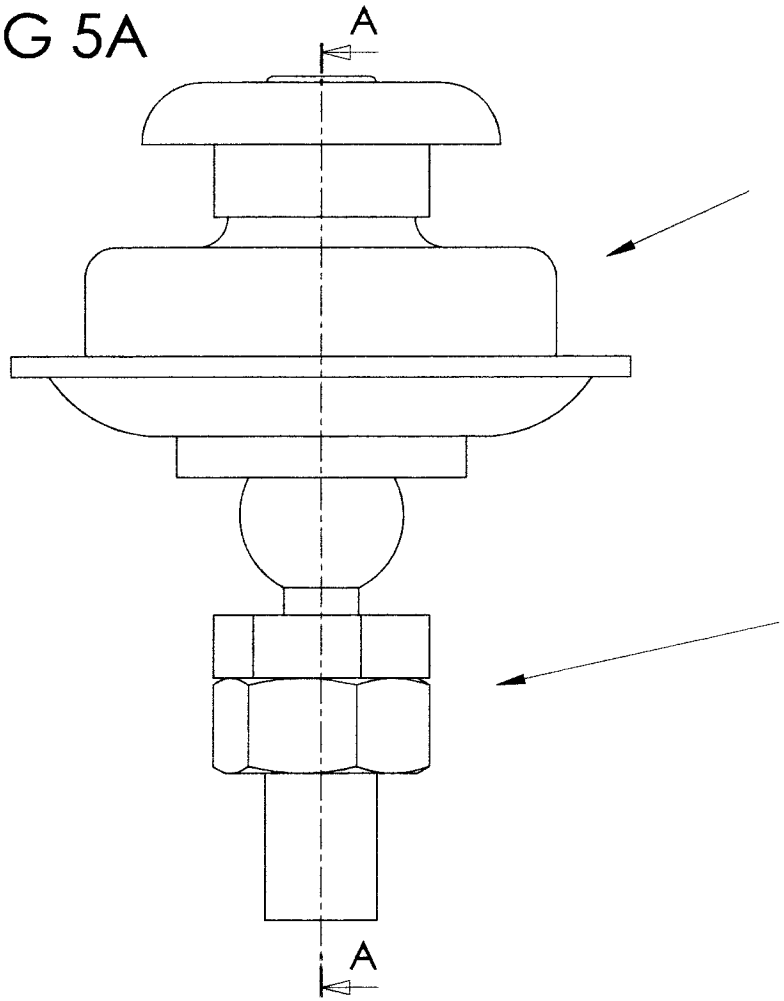
FIG. 5A is a front view of the connector and stud of FIG. 3, in the process of engaging or disengaging, and showing cross-sectional line A-A.
Figure 6B:
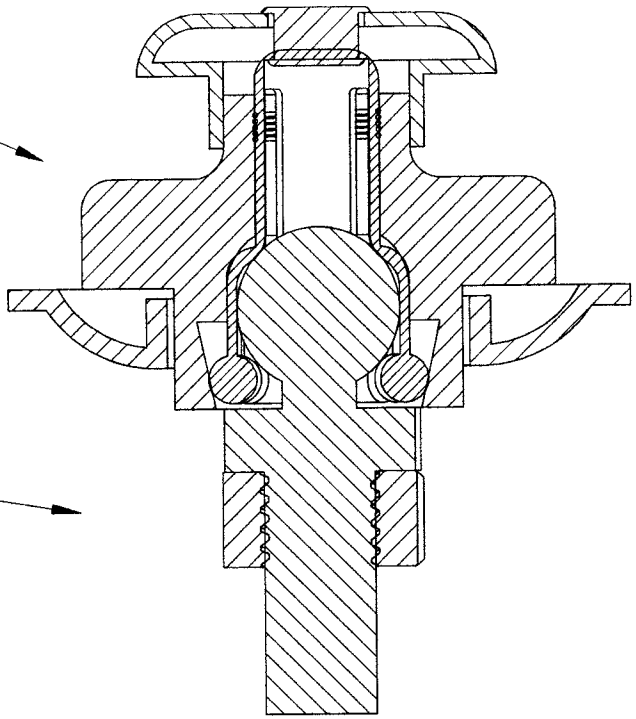
FIG. 6B is a front sectional view of the connector and stud of FIG. 6A, along line A-A.
Figure 6A:
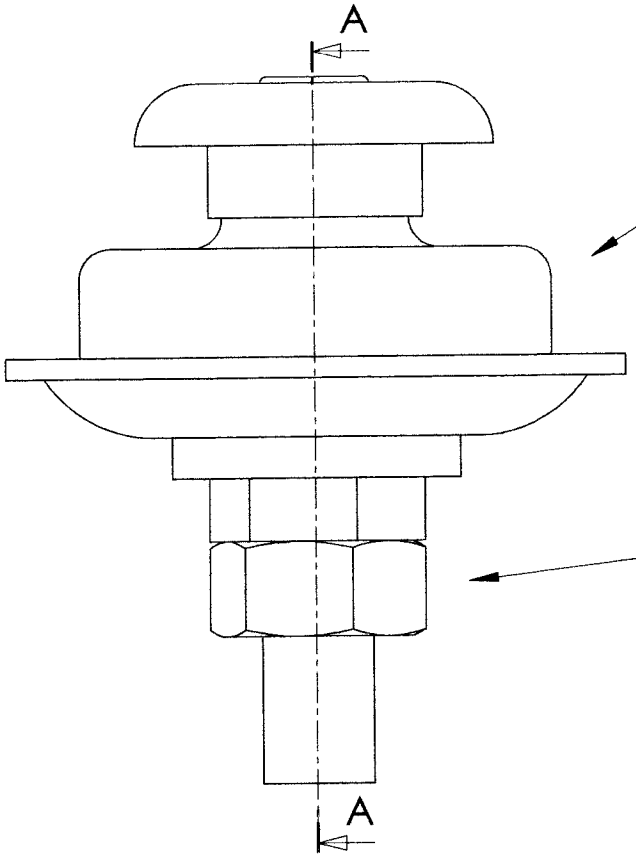
FIG. 6A is a front view of the connector and stud of FIG. 3, in an engaged or fastened position, and showing cross-sectional line A-A.
Figure 7:
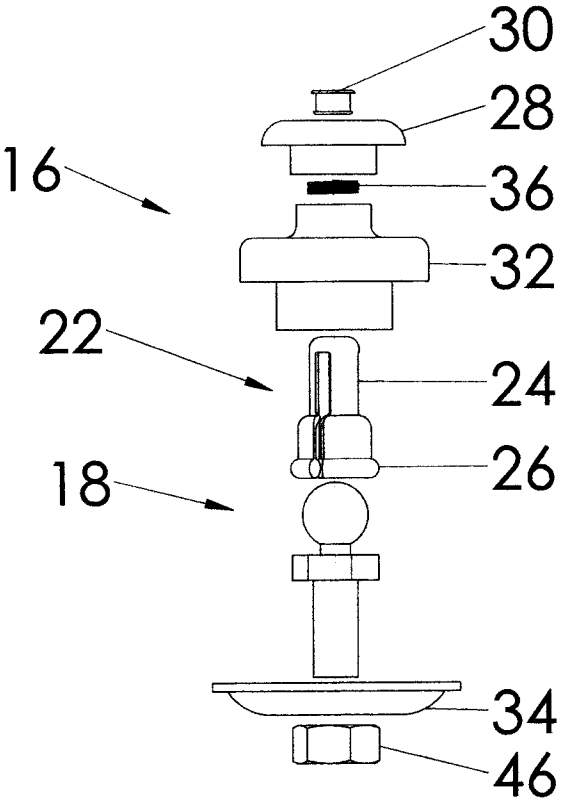
FIG. 7 is a front exploded view of the connector and stud of FIG. 3.

FIG. 3 is a front view of a connector 16 and stud 18 of the helmet fastening system of FIG. 1, in an engaged or fastened position. FIGS. 4A and 4B are, respectively, front side and front sectional views of the connector and stud of FIG. 3, in a disengaged or unfastened position. FIGS. 5A and 5B are, respectively, front side and front sectional views of the connector and stud of FIG. 3, in the process of engaging or disengaging. FIGS. 6A and 6B are, respectively, front side and front sectional views of the connector and stud of FIG. 3, in an engaged or fastened position. FIG. 7 is a front exploded view of the connector and stud of FIG. 3. FIGS. 8A and 8B are, respectively, front exploded and front exploded sectional views of the connector and stud of FIG. 3. Connector 16 comprises a housing 32, an actuator 22, and a collar 34. Housing 32 comprises a recess 50 and an underside with an opening 52 into the recess.

Actuator 22 comprises (i) an upper grasping portion 28 extending outside of housing 32 (ii) a resilient, radially-expanding enlarged lower portion 26, and (iii) a middle portion 24 connecting the lower portion to the upper grasping portion. Lower portion 26 is radially-expanding in that portions of lower portion 26 move outward (away from the longitudinal axis) when outward force is applied by the enlarged head of the stud 18, as discussed below. Lower portion 26 is resilient in the portions of lower portion 26 that move outward (away from the longitudinal axis) when outward force is applied by the enlarged head of the stud return to their original positions when the force from the stud is removed. Actuator 22 is movable within the recess and along a longitudinal axis of the housing between a first position (illustrated in FIG. 6) in which the actuator engages the stud to retain the connector to the helmet and a second position (illustrated in FIG. 5) in which the actuator disengages the stud to release the connector from the helmet. Upper grasping portion 28 is adapted to enable a user to move actuator 22 from the first to the second position. Mechanical fastener 30 (which may comprise, e.g., a rivet) affixes upper grasping portion 28 to actuator 22. Spring 36 biases actuator 22 downward into the first position, as shown in FIGS. 4 and 6.

Recess 50 has an upper portion (the portion in which, in FIG. 6, approximately the top half of the spherical enlarged head 40 of stud 18 resides) sized and shaped to receive at least a top portion of the enlarged head, and a lower portion having an inverse frusto-conical shape that is wider at a top end and narrower at a bottom end.

Figure 9:
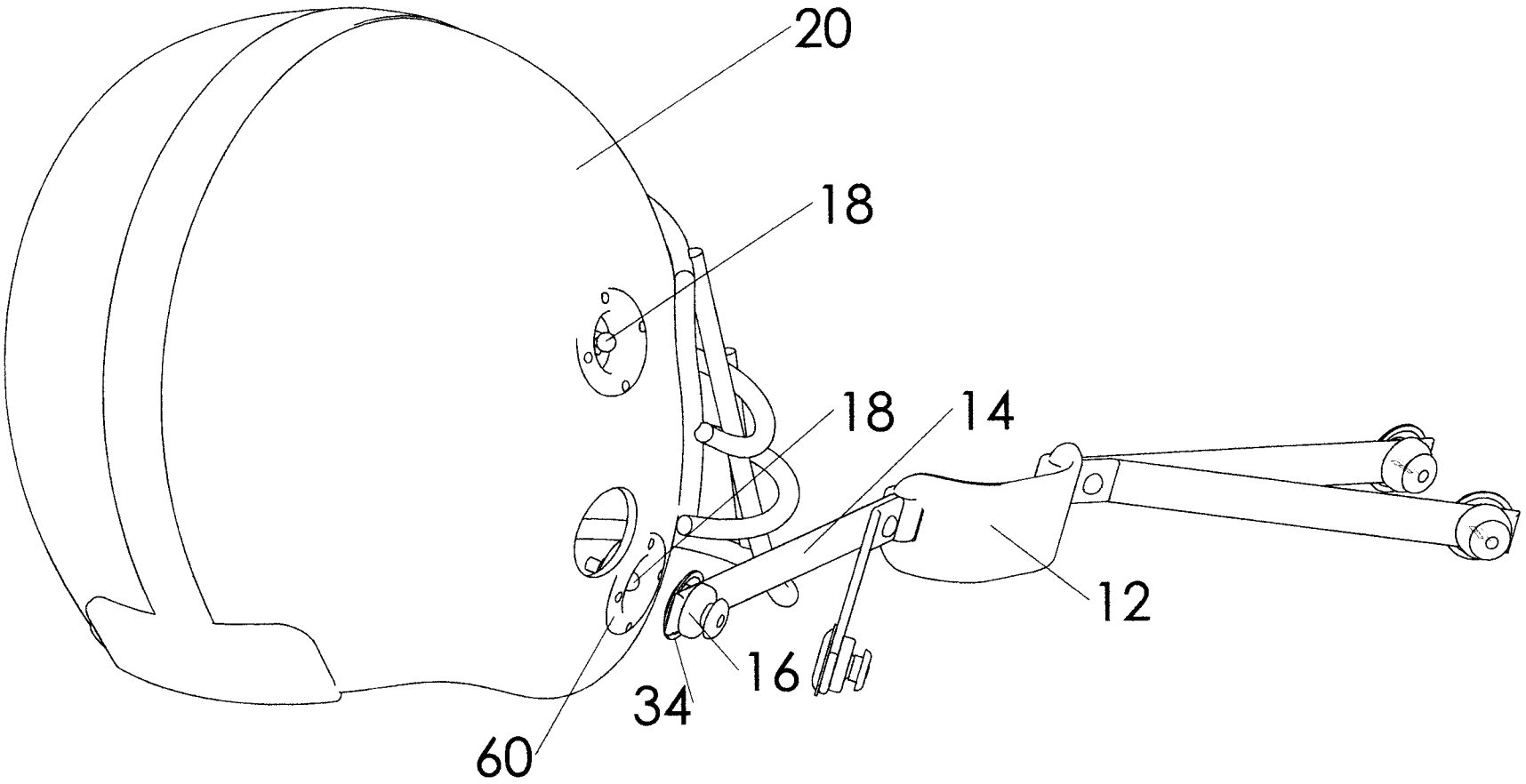
FIG. 9 is a view of the helmet fastening system of FIG. 1 in position to be affixed to a helmet.

When connector 16 is affixed to a strap of a chinstrap, the bottom portion of housing 32 protrudes through a hole in the strap, and collar 34 is press-fit, or threaded (or otherwise affixed) to the protruding bottom portion of the housing. Thus, strap 14 is sandwiched between housing 32 and collar 34, as illustrated in FIG. 9.

Stud 18 comprises an enlarged, generally spherical head 40, shoulder 42, and post 44. When stud 18 is affixed to a helmet (such as helmet 20 of FIG. 9), post 44 (which is typically threaded) protrudes through a hole in the outer shell of the helmet and nut 46 is threaded onto post 44. Thus, the outer shell of helmet 20 is sandwiched between shoulder 42 and nut 46, as illustrated in FIG. 9. However, there are multiple ways in which the stud could be embodied and affixed to a helmet. For example, the stud may comprise an enlarged spherical head affixed to a mounting flange (which would typically, although not necessarily, have a larger diameter than shoulder 42 (in such an embodiment, shoulder 42 and/or post 44 would likely, but not necessarily, be omitted)). In such an embodiment, the mounting flange may be affixed to the interior or exterior of the outer shell of the helmet, such as by way of multiple screws or nuts and bolts, or by way of an adhesive, welding, or any suitable fastening method. In another embodiment, the end of the post opposite the enlarged head could form a rivet that is flattened and expanded after the post is placed through a hole in the helmet, thereby securing the stud in position. The stud could also be molded as an integral part of the helmet. While embodiments of the invention are described herein in which the stud projects outward from the helmet, in alternative embodiments of the invention the stud may project inward from the helmet such that the connector and stud are mated inside the helmet.

The components of connector 16 and stud 18 are further illustrated in FIGS. 7 and 8 which illustrate, respectively, a front exploded view and a front exploded sectional view, in accordance with one embodiment of the invention.

In operation, the enlarged lower portion 26 of the actuator extends at least partly under the enlarged head of the stud when the connector and stud are engaged and the actuator is in the first position. This is illustrated in FIG. 6. The narrower end of the lower portion of the recess restricts outward movement of the enlarged lower portion of the actuator, thereby trapping the enlarged head within the recess and restricting separation of the connector and the stud. In other words, when an attempt is made to separate the connector and the stud without lifting the upper grasping portion (i.e., when the attempt is unintended, perhaps due to snagging of an opposing player's equipment or uniform on the connector or when significant force is applied to the helmet during player-to-player contact), the enlarged head of the stud attempts to push out (radially) the enlarged lower portion of the actuator. However, outward movement is restricted by the narrower end of the lower portion of the recess. As such, the connector and stud cannot readily be separated when the actuator is in the first position.

When it is desired to separate the connector and stud (i.e., to purposely disengage the chinstrap, such as to remove the helmet), upper grasping portion 28 is lifted, which in turn lifts actuator 22 into the second position (illustrated in FIG. 5). When the actuator is in the second position, the wider end of the lower frusto-conical portion of the recess allows outward (radial) movement of the enlarged lower portion of the actuator (the outward movement is caused by movement downward ((i.e., away from upper grasping portion 28) and along the longitudinal axis of connector 16) of the enlarged head of the stud as it begins to exit from recess 50), thereby allowing the enlarged head to fully exit recess 50 and allowing separation of the connector and the stud. After the connector and stud are separated, upper grasping portion may be released and spring 36 causes actuator 22 to return to the first position, as illustrated in FIG. 4.

When it is desired to again engage the connector and stud (to engage the chinstrap), the connector is pushed down onto the stud, such that the stud enters the recess. As the stud enters the recess, the enlarged head of the stud pushes the actuator up and into the second position (illustrated in FIG. 5). With the actuator in the second position, the wider end of the lower frusto-conical portion of the recess allows outward (radial) movement of the enlarged lower portion of the actuator (the outward movement is caused by movement upward ((i.e., toward the upper grasping portion) and along the longitudinal axis of the connector) of the enlarged head of the stud as it begins to enter the recess), thereby allowing the enlarged head to fully enter the recess. Typically, it is not necessary to lift the upper grasping portion to engage the connector and stud (but it could be done), as the force of the stud entering the recess causes the necessary upward movement of the actuator into the second position. Once the connector and stud are engaged, the spring causes the actuator to return to the first position.

The embodiment of the invention described above may be retrofitted to an existing helmet that uses the old style "snap" type connector by simply replacing the male portion(s) of the "snap" type connector on the helmet with stud(s) 18 and replacing the chinstrap with a chinstrap having one or more of connector 16.

The generally spherical shape of the enlarged head of the stud, coupled with the generally circular cross-sectional shape of the connector (in a plane perpendicular to the longitudinal axis), enable the connector to rotate and change angle about the stud without disconnecting. This ability to rotate prevents mechanical stresses to the connection point caused by movement of the chinstrap, and also enables the chinstrap to be secured in multiple positions and at multiple angles thereby increasing the comfort of the wearer.

One potential shortcoming of the embodiment of the invention illustrated in FIG. 2 is how far the engaged connector and stud project from the outer shell of the helmet, presenting a potential snag point. Alternative embodiments which address this shortcoming are illustrated in FIGS. 10-17. In the alternative embodiments of FIGS. 10-17, connector 16 is affixed to strap 14 as described above. However, rather than being affixed directly to the outer shell of the helmet as described above, the stud is affixed either within a recess defined in the outer shell or within a recess assembly mounted in or adjacent a hole defined in the outer shell. The recess or recess assembly is sized such that at least a portion of the stud is below the surface of the outer shell, and also such that at least a portion of the connector is below the surface of the outer shell when the connector is attached to the stud.

Figure 10:
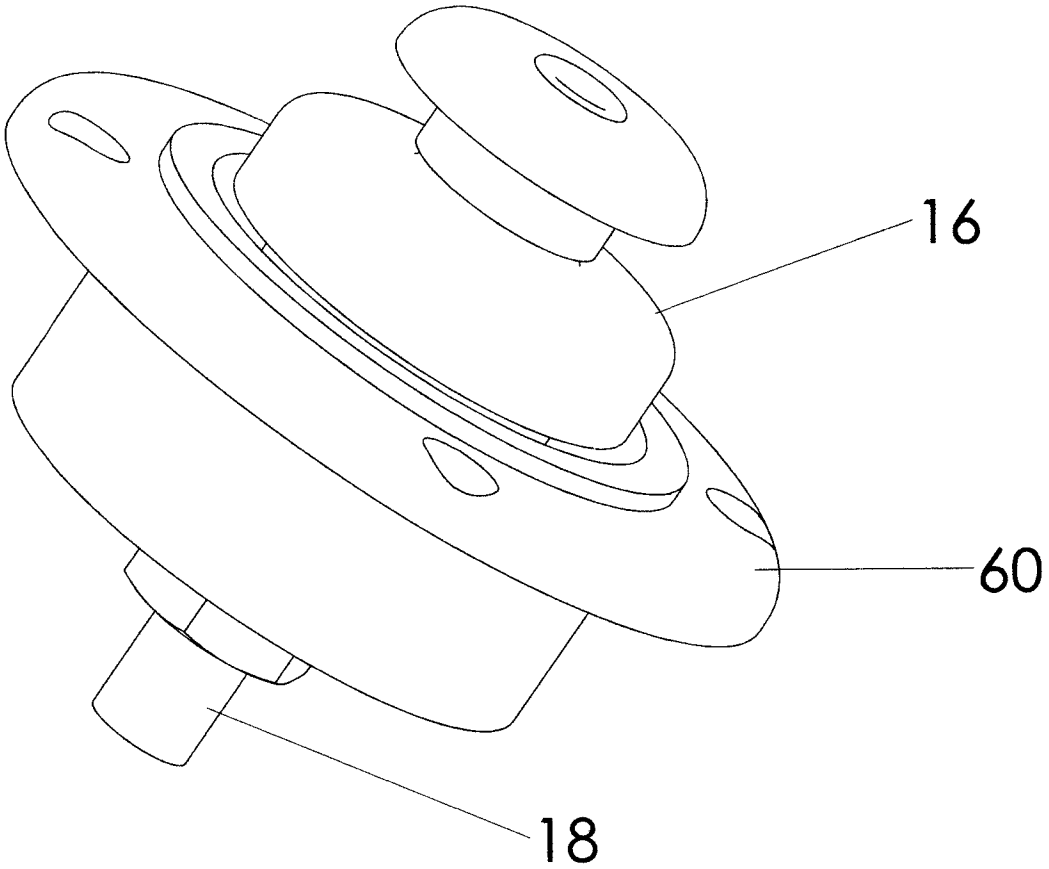
FIG. 10 is an isometric view of a connector, stud, and recess assembly of a helmet fastening system, in an engaged or fastened position, in accordance with an alternative embodiment of the present invention.
Figure 11:
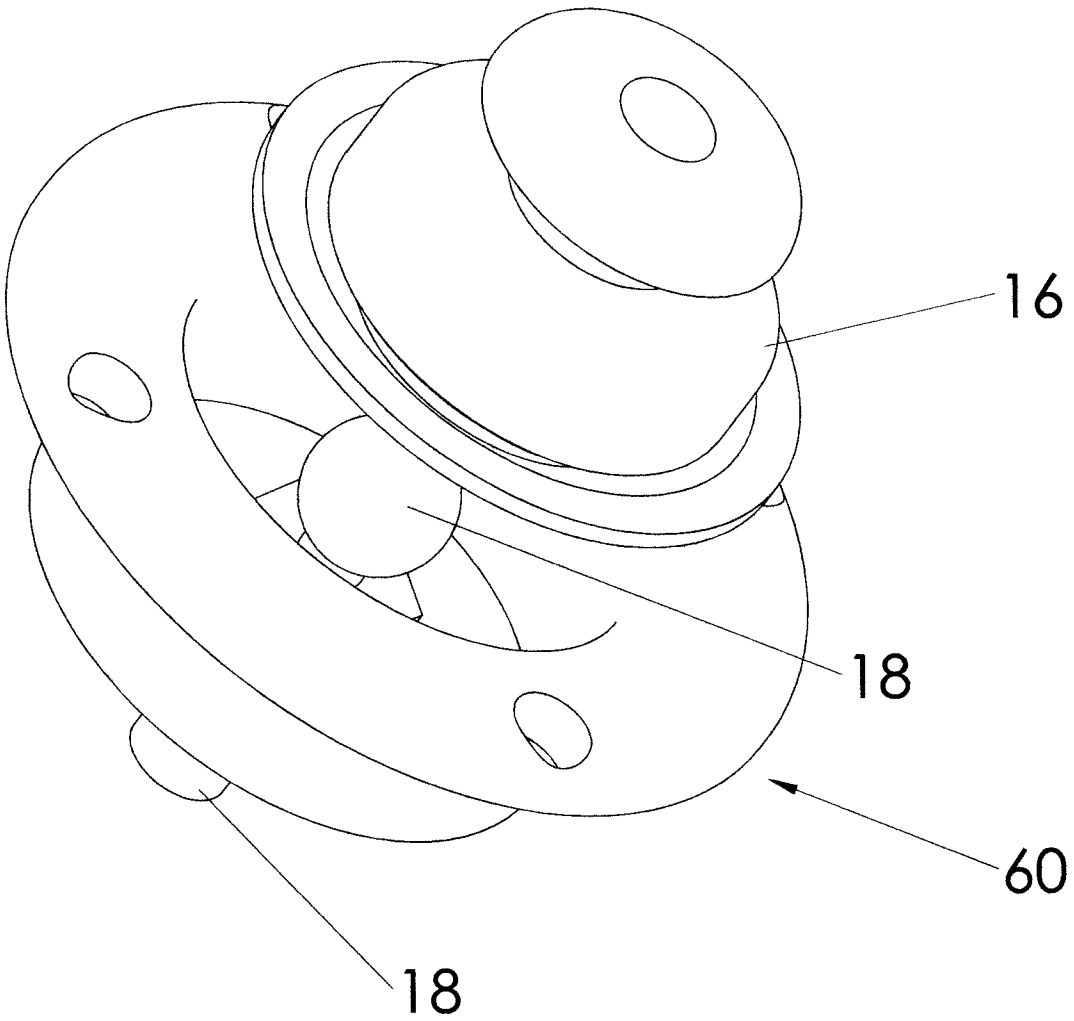
FIG. 11 is an isometric view of the connector, stud, and recess assembly of the helmet fastening system of FIG. 10, in a disengaged or unfastened position.
Figure 12:
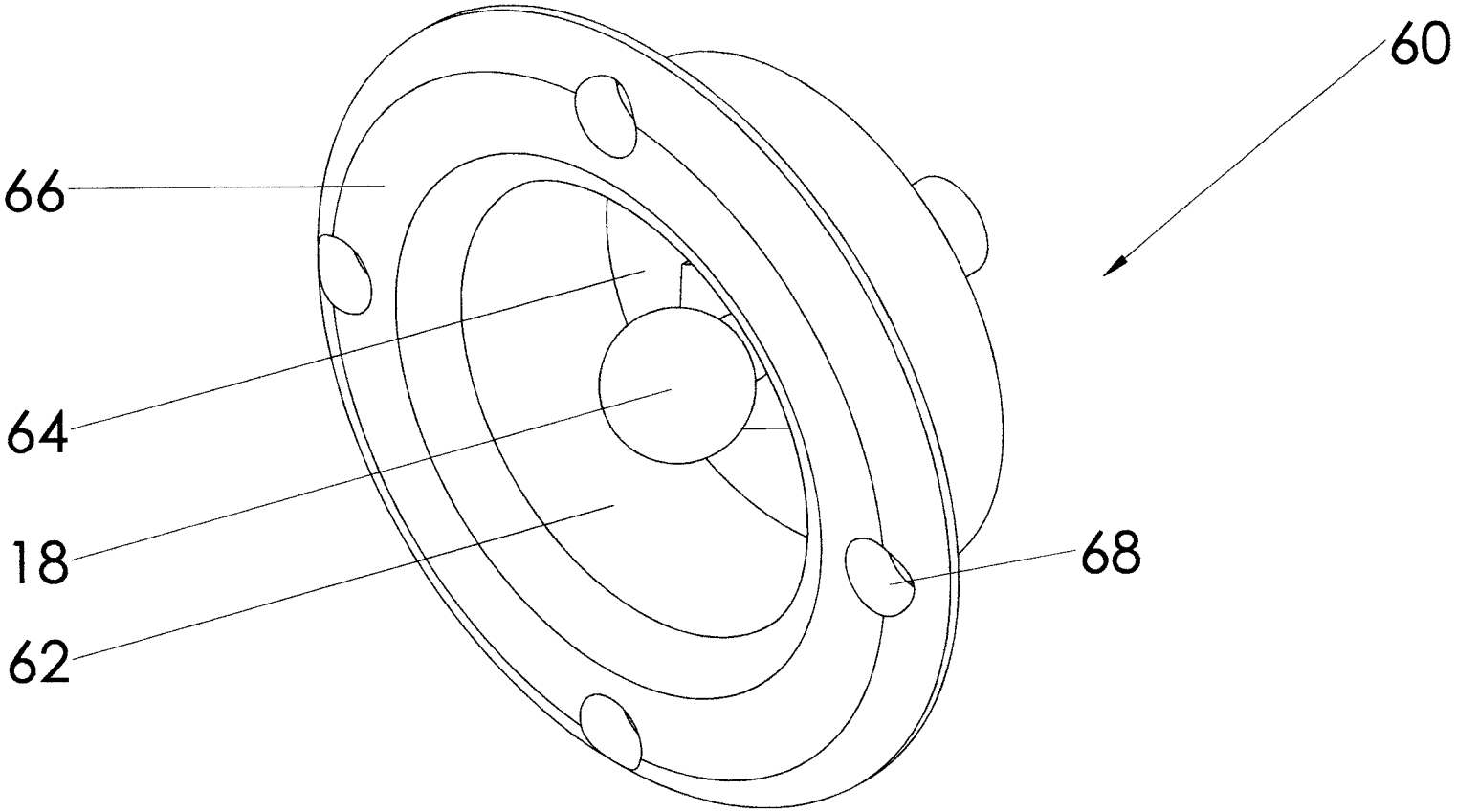
FIG. 12 is an isometric view of the stud and recess assembly of the helmet fastening system of FIG. 10.
Figure 13A:
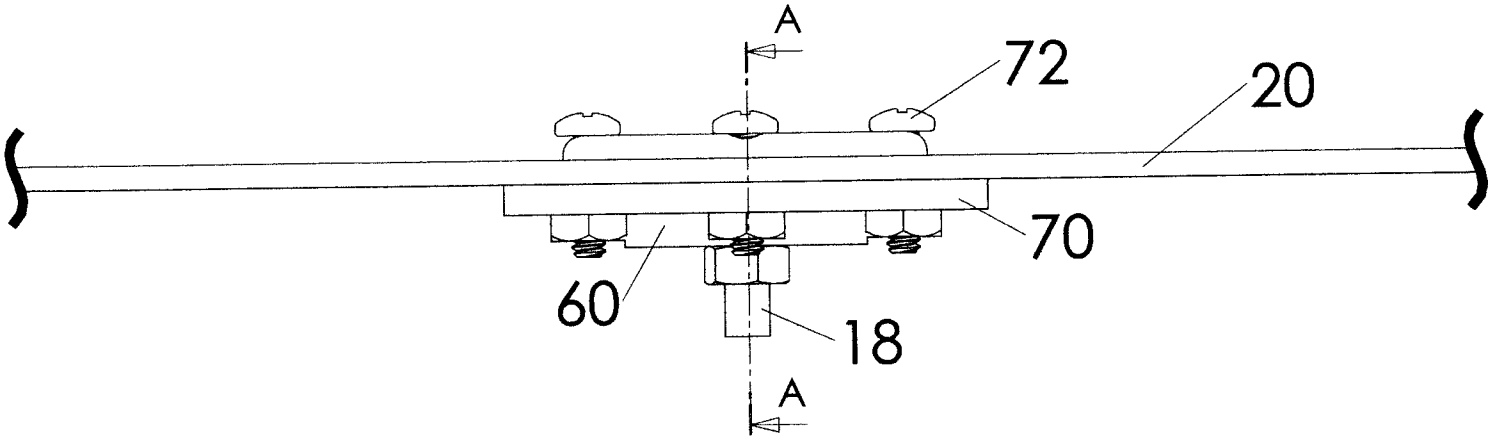
FIG. 13A is a partial side view of the stud and recess assembly of the helmet fastening system of FIG. 10, mounted to a helmet, showing cross-sectional line A-A.
Figure 13B:
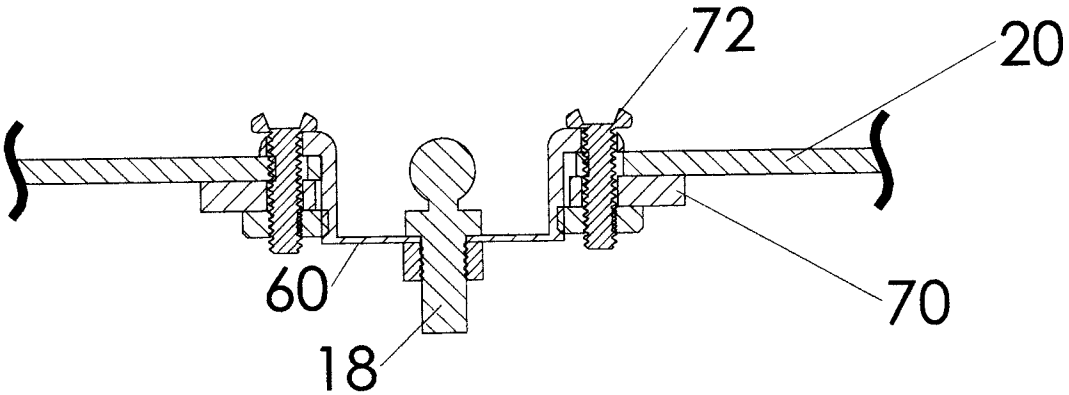
FIG. 13B is a partial sectional view of the stud and recess assembly of FIG. 13A, along line A-A.

In one embodiment of the invention, illustrated in FIGS. 10-13, a recess assembly 60 is mounted in a hole defined in the outer shell of helmet 20. Recess assembly 60 comprises wall portion 62, floor portion 64 affixed to and closing off one end of wall portion 62, and flange 66 affixed to an opposite end of wall portion 62 and extending outward from the wall portion. Stud 18 is affixed to floor portion 64. Recess assembly 60 is mounted in the hole in the outer shell of the helmet such that flange 66 is flush with the outer surface of the outer shell, as illustrated in FIGS. 13A and 13B. Recess assembly 60 may be affixed to the outer shell of the helmet using screws or bolts inserted through holes 68, or any other suitable method of affixation. Backing washer 70 may be mounted flush to the inner wall of the outer shell as illustrated in FIG. 13 for additional strength and rigidity, if desired. As illustrated in FIGS. 10-12, the recess assembly may be generally cylindrical in shape, or may have a different shape if desired.

Figure 14A:
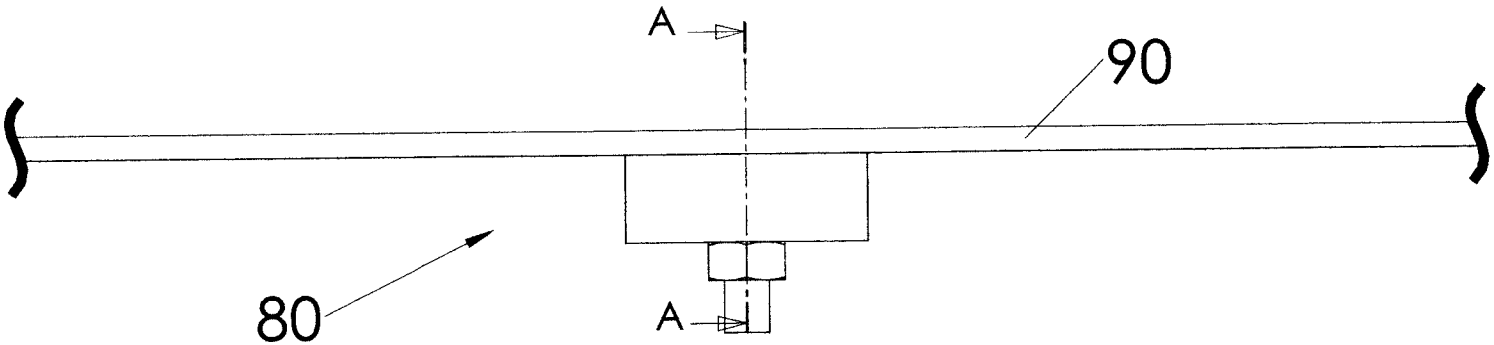
FIG. 14A is a partial side view of a helmet, stud, and recess of a helmet assembly, showing cross-sectional line A-A, in accordance with an alternative embodiment of the present invention.
Figure 14B:
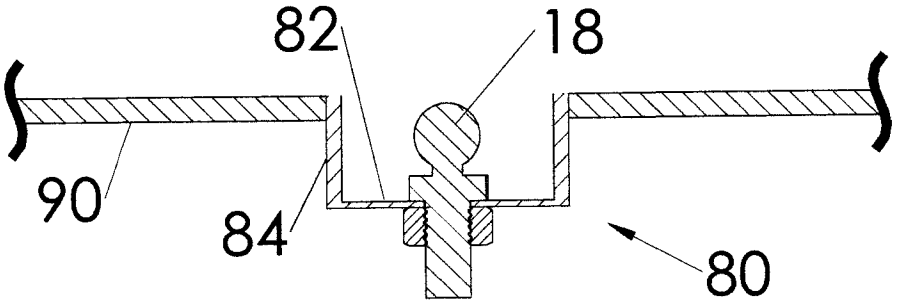
FIG. 14B is a partial sectional view of the helmet, stud, and recess of FIG. 14B, along line A-A.

In the embodiment illustrated in FIGS. 14A and 14B, recess 80 is molded into the outer shell of helmet 90. The molded recess comprises wall portion 84 and floor portion 82. One end of wall portion 84 abuts the outer shell and floor portion 82 abuts and closes off an opposite end of wall portion 84. Stud 18 is affixed to floor portion 82. The molded recess may be generally cylindrical in shape, or may have a different shape if desired.

Figure 15A:
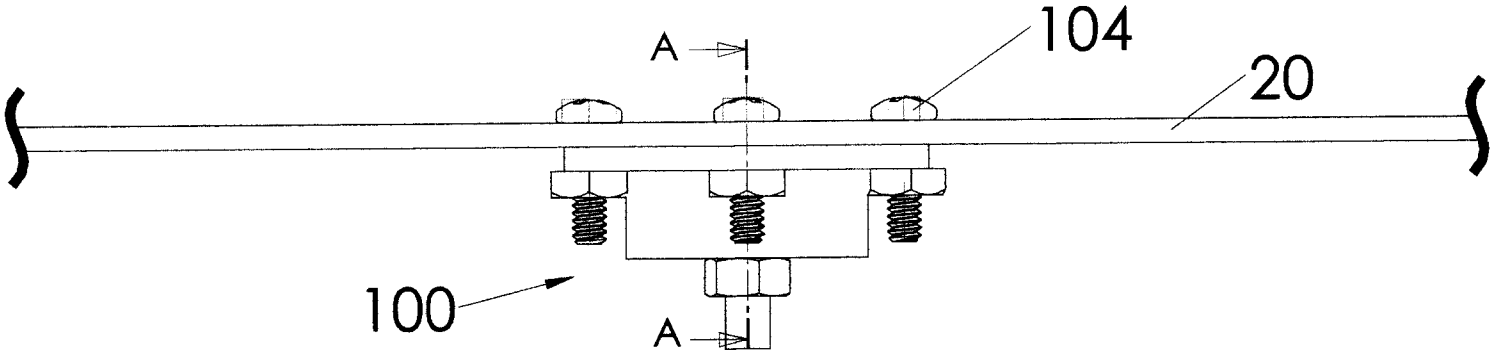
FIG. 15A is a partial side view of a helmet, stud, and recess assembly, showing cross-sectional line A-A, in accordance with an alternative embodiment of the present invention.
Figure 15B:
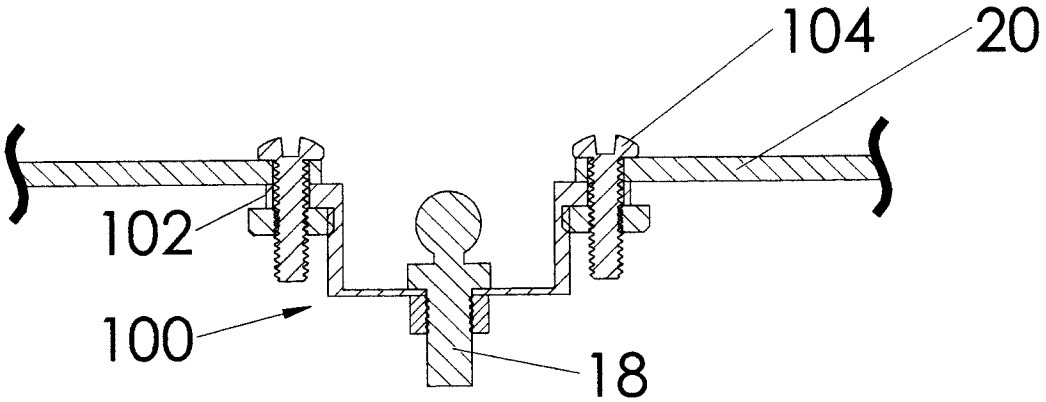
FIG. 15B is a partial sectional view of the helmet, stud, and recess assembly of FIG. 15A, along line A-A.

In the embodiment illustrated in FIGS. 15A and 15B, recess assembly 100 is mounted adjacent the hole in the outer shell of the helmet such that flange 102 is flush with the inner surface of the outer shell. Recess assembly 100 may be affixed to the outer shell of the helmet using screws 104, bolts, or any other suitable method of affixation.

Figure 16A:
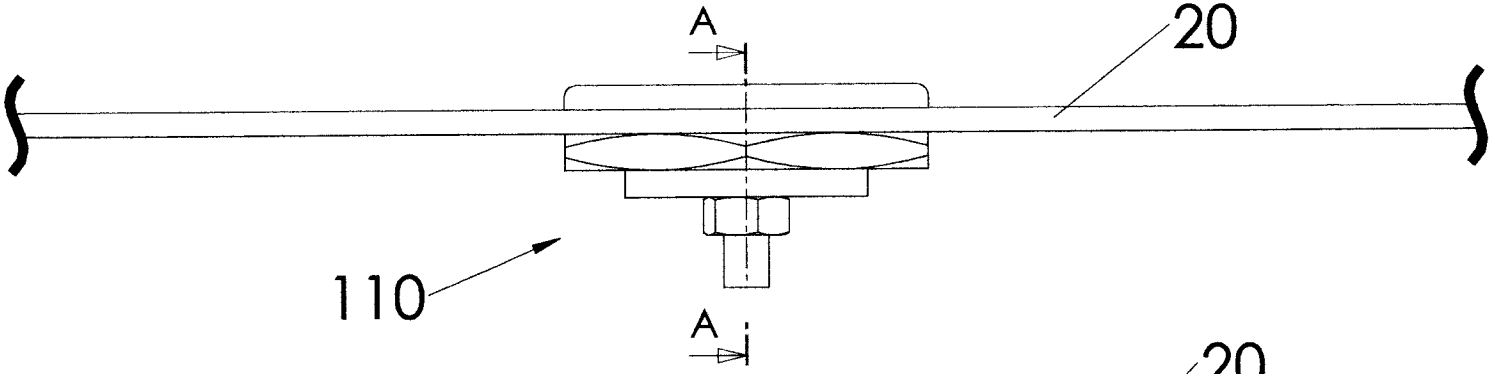
FIG. 16A is a partial side view of a helmet, stud, and recess assembly, showing cross-sectional line A-A, in accordance with an alternative embodiment of the present invention.
Figure 16B:
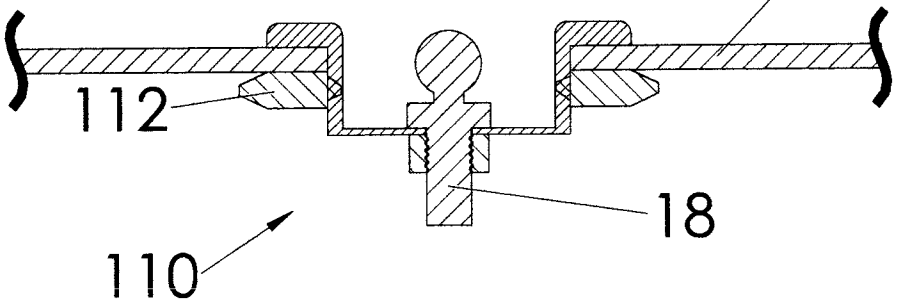
FIG. 16B is a partial sectional view of the helmet, stud, and recess assembly of FIG. 16A, along line A-A.

In the embodiment illustrated in FIGS. 16A and 16B, recess assembly 110 is similar to recess assembly 60 of FIGS. 10-13. However, in recess assembly 110 the outer surface of the wall portion is threaded and the inner surface of backing nut 112 is correspondingly threaded as illustrated in FIG. 16. As such, the threaded mating of recess assembly 110 and backing nut 112 secures recess assembly 110 in place.

Figure 17A:
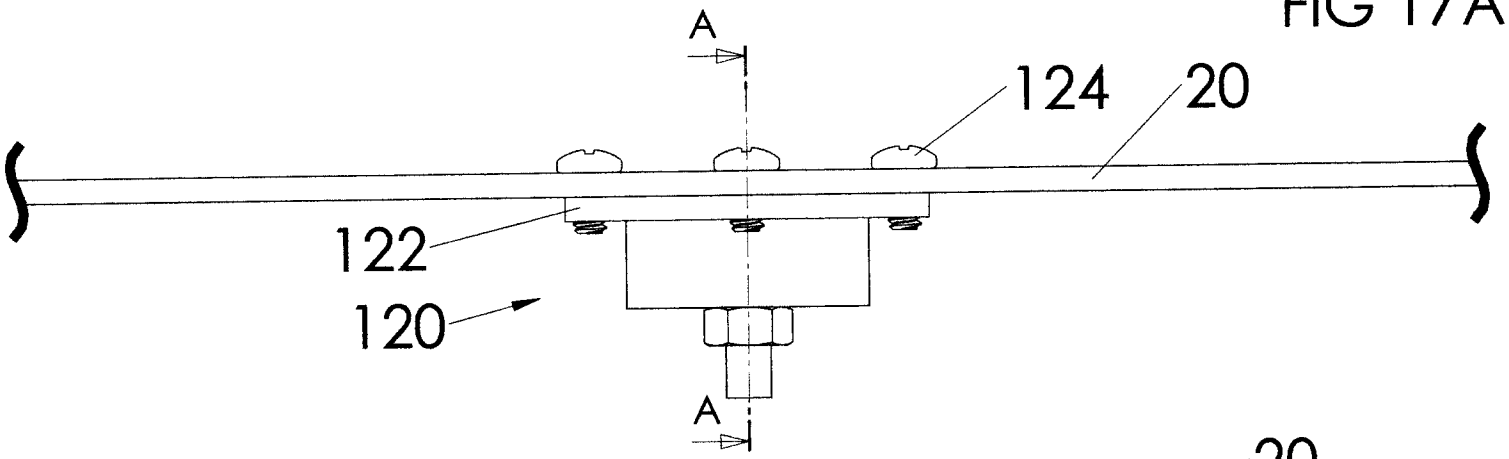
FIG. 17A is a partial side view of a helmet, stud, and recess assembly, showing cross-sectional line A-A, in accordance with an alternative embodiment of the present invention.
Figure 17B:
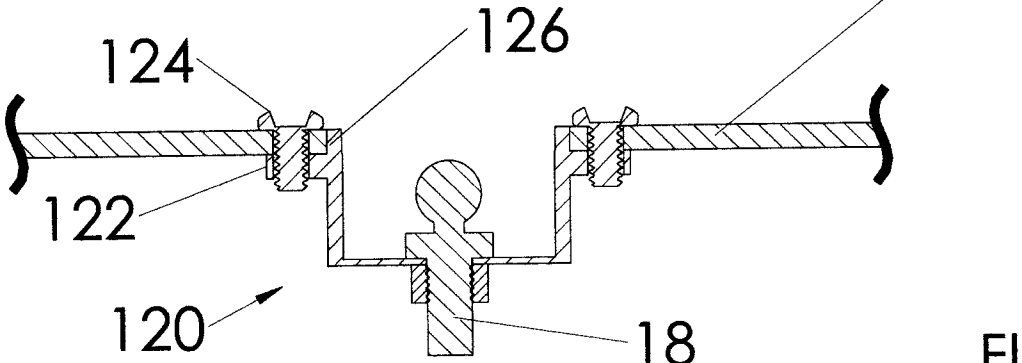
FIG. 17B is a partial sectional view of the helmet, stud, and recess assembly of FIG. 17A, along line A-A.

In the embodiment illustrated in FIGS. 17A and 17B, recess assembly 120 has a flange that is affixed to the wall portion at a predetermined distance from the outer end of the wall portion (i.e., the end opposite the floor portion). As illustrated, the distance corresponds to the thickness of the outer shell. As such, recess assembly 120 is mounted in the hole such that flange 122 is flush with the inner surface of the outer shell and the outer end 126 of the wall portion is flush with the outer surface of the outer shell. Recess assembly 120 may be affixed to the outer shell of the helmet using screws 124, bolts, or any other suitable method of affixation.

In either the embodiment illustrated in FIGS. 10-17 or in the embodiment illustrated in FIG. 14, stud 18 that is mounted within a recess or recess assembly may comprise an enlarged, generally spherical head 40, shoulder 42, and post 44. When stud 18 is mounted in the recess or recess assembly, post 44 (which is typically threaded) protrudes through a hole in the floor of the recess or recess assembly and nut 46 is threaded onto post 44. Thus, the floor of the recess or recess assembly is sandwiched between shoulder 42 and nut 46, as illustrated in FIGS. 13 and 14. However, there are multiple ways in which the stud could be embodied and mounted within the recess or recess assembly. For example, the stud may comprise an enlarged spherical head affixed to a mounting flange (which would typically, although not necessarily, have a larger diameter than shoulder 42). In such an embodiment, the mounting flange would be affixed to the floor of the recess or recess assembly, such as by way of multiple screws or nuts and bolts, or by way of an adhesive, welding, or by any suitable fastening method. Alternatively, the stud could be formed (such as by molding) as an integral part of the floor of the recess or recess assembly.

As used herein, the term "affixed" is meant to encompass both mechanical or adhesive fixation of initially separate components, and also to encompass construction of multiple described components as a single, unitary piece. For example, the stud is described herein as being affixed to a helmet. This could mean mechanical affixation as illustrated in FIG. 9 (or other types of mechanical or adhesive fixation), or could mean that the helmet and stud are molded together as a single, unitary piece.

The components of embodiments of the invention described herein may be constructed out of any suitable material or materials. For example, the stud to which the connector is affixed may be constructed of steel, stainless steel, plastic (any suitable type of plastic), Kevlar, carbon fiber, composite materials, or any other suitable material. The recess assembly may be constructed of steel, stainless steel, plastic (any suitable type of plastic), Kevlar, carbon fiber, composite materials, or any other suitable material. The chinstrap may be constructed of plastic (any suitable type of plastic), fabric, metal, or any other suitable material. The connector may be constructed of steel, stainless steel, plastic (any suitable type of plastic), Kevlar, carbon fiber, composite materials, or any other suitable material.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. A helmet assembly comprising:

a helmet comprising an outer shell, a recess defined in the outer shell, and a stud affixed within the recess such that at least a portion of the stud is below a surface of the outer shell; and a chinstrap comprising a connector affixed to the chinstrap configured to releasably attach to the stud to retain the chinstrap to the helmet;

wherein the recess is sized such that at least a portion of the connector is below the surface of the outer shell when the connector is attached to the stud;

wherein the stud comprises an enlarged head, and wherein the connector comprises:

a housing comprising a recess and an underside with an opening into the recess; and an actuator movable within the recess and along a longitudinal axis of the housing between a first position in which the actuator engages the stud to retain the connector to the helmet and a second position in which the actuator disengages the stud to release the connector from the helmet;

wherein the actuator comprises (i) an upper grasping portion extending outside of the housing and adapted to enable a user to move the actuator from the first to the second position, (ii) a resilient, radially-expanding enlarged lower portion, and (iii) a middle portion connecting the lower portion to the upper portion;

wherein the recess has an upper portion sized to receive at least a top portion of the enlarged head and a lower portion comprising an inverse frusto-conical shape that is wider at a top end and narrower at a bottom end;

wherein the enlarged lower portion of the actuator extends at least partly under the enlarged head of the stud when the actuator is in the first position, with the narrower end of the lower portion of the recess restricting outward movement of the enlarged lower portion of the actuator, thereby trapping the enlarged head within the recess and restricting separation of the connector and the stud;

wherein, when the actuator is in the second position, the wider end of the lower portion of the recess allows outward movement of the enlarged lower portion of the actuator, thereby allowing the enlarged head to exit the recess and allowing separation of the connector and the stud.

2. The helmet assembly of claim 1, wherein the connector further comprises a spring to bias the actuator toward the first position.

3. The helmet assembly of claim 1, wherein the recess is molded into the outer shell.

4. The helmet assembly of claim 1, wherein the recess comprises:

a wall portion, one end of the wall portion abutting the outer shell; and a floor portion abutting and closing off an opposite end of the wall portion;

wherein the stud is affixed to the floor portion.

5. A helmet assembly comprising:

a helmet comprising an outer shell, a hole defined in the outer shell, a recess assembly mounted in or adjacent the hole defined in the outer shell, and a stud affixed within the recess assembly such that at least a portion of the stud is below a surface of the outer shell; and a chinstrap comprising a connector affixed to the chinstrap configured to releasably attach to the stud to retain the chinstrap to the helmet;

wherein the recess assembly is sized such that at least a portion of the connector is below the surface of the outer shell when the connector is attached to the stud;

wherein the stud comprises an enlarged head, and wherein the connector comprises:

a housing comprising a recess and an underside with an opening into the recess; and an actuator movable within the recess and along a longitudinal axis of the housing between a first position in which the actuator engages the stud to retain the connector to the helmet and a second position in which the actuator disengages the stud to release the connector from the helmet;

wherein the actuator comprises (i) an upper grasping portion extending outside of the housing and adapted to enable a user to move the actuator from the first to the second position, (ii) a resilient, radially-expanding enlarged lower portion, and (iii) a middle portion connecting the lower portion to the upper portion;

wherein the recess has an upper portion sized to receive at least a top portion of the enlarged head and a lower portion comprising an inverse frusto-conical shape that is wider at a top end and narrower at a bottom end;

wherein the enlarged lower portion of the actuator extends at least partly under the enlarged head of the stud when the actuator is in the first position, with the narrower end of the lower portion of the recess restricting outward movement of the enlarged lower portion of the actuator, thereby trapping the enlarged head within the recess and restricting separation of the connector and the stud;

wherein, when the actuator is Ire the second position, the wider end of the lower portion of the recess allows outward movement of the enlarged lower portion of the actuator, thereby allowing the enlarged head to exit the recess and allowing separation of the connector and the stud.

6. The helmet assembly of claim 5, wherein the connector further comprises a spring to bias the actuator toward the first position.

7. The helmet assembly of claim 5, wherein the recess assembly comprises:

a wall portion;

a floor portion affixed to and closing off one end of the wall portion; and a flange affixed to an opposite end of the wall portion and extending outward from the wall portion;

wherein the stud is affixed to the floor portion; and wherein the recess assembly is mounted in the hole such that the flange is flush with an outer surface of the outer shell.

8. The helmet assembly of claim 5, wherein the recess assembly comprises:

a wall portion;

a floor portion affixed to and closing off one end of the wall portion; and a flange affixed to an opposite end of the wall portion and extending outward from the wall portion;

wherein the stud is affixed to the floor portion; and wherein the recess assembly is mounted adjacent the hole such that the flange is flush with an inner surface of the outer shell.

9. The helmet assembly of claim 5, wherein the recess assembly comprises:

a wall portion;

a floor portion affixed to and closing off one end of the wall portion; and a flange affixed to the wall portion and extending outward from the wall portion;

wherein the stud is affixed to the floor portion;

wherein the flange is affixed to the wall portion at a distance from an end of the wall portion opposite the floor portion, the distance corresponding to a thickness of the outer shell; and wherein the recess assembly is mounted in the hole such that the flange is flush with an inner surface of the outer shell and the end of the wall portion opposite the floor portion is flush with an outer surface of the outer shell.

* * * * *